United States Patent [19]

Sherman

[11] 4,034,658

[45] July 12, 1977

[54] TRAY FEEDER SYSTEM

[75] Inventor: Earle C. Sherman, West Monroe, La.

[73] Assignees: Olinkraft, Inc., West Monroe, La.; Anheuser-Busch, Incorporated, St. Louis, Mo.

[21] Appl. No.: 626,210

[22] Filed: Oct. 28, 1975

[51] Int. Cl.[2] ..... B31B 3/02

[52] U.S. Cl. ..... 93/49 M; 93/49 R; 93/53 SD

[58] Field of Search ..... 93/53 SD, 53 R, 53 M, 93/52, 49 M, 49 R; 271/99, 100, 101, 11, 12, 14; 53/186

[56] References Cited

U.S. PATENT DOCUMENTS

| | | | |
|---|---|---|---|
| 2,564,417 | 8/1951 | Baker et al. | 271/100 |
| 2,745,665 | 5/1956 | Labombarde | 271/103 |
| 2,796,256 | 6/1957 | Robertson | 271/11 |
| 3,162,988 | 12/1964 | Sherman | 271/12 UX |
| 3,431,826 | 3/1969 | Gentry | 93/52 |
| 3,745,892 | 7/1973 | Ganz | 93/49 M |
| 3,844,088 | 10/1974 | McDonough et al. | 93/53 SD X |

*Primary Examiner*—James F. Coan
*Attorney, Agent, or Firm*—C. Emmett Pugh; Thomas S. Keaty; Norvell E. Von Behren

[57] ABSTRACT

A tray feeder including a corrugated sheet folding apparatus for rapidly feeding a plurality of corrugated sheets stored in a gravity hopper attached to the apparatus and folding the sheets into a tray shape for reception of cans or other goods, the feeding and folding of the sheets being done in a continuous, smooth and rapid flow (as opposed to the intermittent flow of the tray feeders of the prior art). The corrugated sheets are stacked in the hopper in such a manner that the upper portion of the foremost sheet is overhung in relation to the central and lower portion of the same sheet with the overhung stacking of the sheets causing the foremost sheets to separate at the upper portion thereof thereby breaking the vacuum between the upper portions of the sheets. The feeding section of the machine includes vacuum means and a split wheel roller system for withdrawing the overhung upper portions of the foremost corrugated sheets rapidly from the hopper in a timed sequence and transporting the sheet to the folding section of the apparatus. The folding section of the apparatus, located at the junction of three separate but coordinated special conveyor systems, includes folding means and hold-down means for raising the sides of the corrugated sheets to form tray cartons in timed synchronization with the feeding section. Each of the three conveyor systems includes special lugs that work in conjunction with a second, split wheel roller system to form in vertical, opposed alignment the ends of the tray carton. Also disclosed is a method of continuously and rapidly feeding corrugated sheets, stacked in a gravity feed hopper, one at a time to a plurality of feed rollers and conveyors and for rapidly folding the corrugated sheets into tray cartons for use with a packaging machine.

26 Claims, 14 Drawing Figures

TRAY FEEDER SYSTEM

BACKGROUND OF THE INVENTION

1. Field of the Invention

This invention relates generally to a tray feeder including a corrugated sheet feeding and folding apparatus and more particularly to a new and improved corrugated sheet feeding and folding apparatus and method for rapidly feeding a plurality of corrugated sheets, stacked in a hopper, one at a time to a plurality of conveyance rollers and folding these sheets into a tray carton for receiving articles to be packaged on a packaging machine.

2. Description of the Prior Art

In the art of designing corrugated sheet folding apparatus for tray cartons for use as containers for a plurality of objects such as bottles, cans or the like, at high speed, it is necessary to process each corrugated sheet with minumum hold up time at each stage of the operation, including the feeding, delivery, folding and transporting stages. Any hold-up of the sheet that prevents the processing of the next sheet will slow down the over-all processing of the sheets which is undesirable.

Several types of sheet processing systems have been known and used before, and typical examples thereof in high speed, corrugated preformed sheet folding are shown in the following U.S. Pat. Nos:

| Pat. No. | Inventor | Issue date |
|---|---|---|
| 2,745,665 | Labombarde | May 15, 1956 |
| 2,796,256 | B. L. Robertson | June 18, 1957 |
| 3,166,311 | J. Rabinow | January 19, 1965 |
| 3,315,575 | A. A. Pinto | April 25, 1967 |
| 3,429,570 | J. W. Scully | February 25, 1969 |
| 3,625,505 | Robert F. Lense | December 7, 1973 |
| 3,745,892 | Robert H. Bant | July 17, 1973 |

All of the above references show feeding and/or folding devices including hoppers for storage of the blank sheets which are inclined or horizontal to break the vacuum between sheets and the adhesion of the ink printed on the sheets to the next sheet for the extraction of single sheets.

The Labombarde patent teaches a plurality of suction devices 114, 115, 116, 117, working in series with bellows suction 217 to extract sheets stored in an upwardly inclined hopper which slows down the feed process.

The Robertson patent teaches a suction device 12 working in cooperation with gripper jaws 13, 17 to separate and pull sheets from a horizontal stack for placement elsewhere. This process is inherently slow because of the necessity of manipulating the jaws and the coordination of the suction and the jaws to prevent the taking of multiple sheets at one time.

The Rabinow patent teaches the use of vacuum arms 20 and 22 for pulling corrugated sheets away from an upwardly inclined hopper to a pair of jaws having rollers 85 thereon. The use of a vacuum alone to pull the sheets from one to another and the mechanical motion of the jaws inherently slow down the feed process.

The Pinto patent teaches the use of suction means 56 for extracting partially assembled cartons from an inclined hopper, the cartons being held at an upwardly inclined hopper with arms 22, 23 used to support the remaining sheets and attempt to separate individual sheets. The use of mechanical arms 22, 23 inherently slows down the feed process.

The Scully patent shows a plurality of blank sheets 10 stacked in an upwardly inclined hopper and fed downwardly by means of a plurality of spaced feed chains 42. As the foremost sheet reaches the proximity of the feed rolls, the adhesion between it and the next sheet is broken by means of applying a downward pressure at an angle to the top edges of the foremost groups of blanks in order to effect a fanning action on the sheets, with provision being made for directing streams of compressed air against the sides of the foremost groups of blanks in order to counteract the tendency of the blanks to stick together by vacuum.

This approach was used with the type of packaging machine used to package what is known in the art as a "wrap-around package" wherein the carton blank is wrapped completely around the bottles or other objects with its ends being locked in place by various locking means contained on the ends of the carton. Such feeding apparatus as disclosed in the Scully patent was satisfactory for medium carton speeds in the range of 200 to 225 cartons per minute. However, with the advent of higher packaging speeds and newer types of packages, the problems encountered with this type of feeding apparatus have become numerous.

The Lense patent teaches the use of a plurality of suction devices 44 extracting partially completed cartons 10 from a horizontal stack in a horizontal hopper rather than a series of sheets with the inherent problems of vacuum sticking and ink adhesion.

The Bant patent teaches the use of suction device 43 to extract sheets 11 from an upwardly inclined hopper 12 without other provisions for the vacuum sticking and ink adhesion to prevent the feed of more than a single sheet at a time.

The Labombarde, Pinto, Lense and Bant patents also disclose various methods of folding the sheets. The Labombarde apparatus folds the carton in the throat 70–71 of the feed mechanism further slowing down its processing. The Bant apparatus utilizes the wrap-around folding section referred to in the discussion of the Scully apparatus and does not fold conventional cartons. The Pinto and Lense apparati are used for the folding of partially formed cartons rather than corrugated sheets.

With respect to the feeding section of the tray feeder reference is also had to the following patents:

| Country/Pat. No. | | Inventor/Applicant | Issue Date |
|---|---|---|---|
| United States | 2,540,489 | P. R. Pretzer | February 6, 1951 |
| Great Britain | 3,440 | R. E. Machine Co., Ltd. | February 10, 1912 |
| Germany | 598,809 | E. Questor | July 16, 1934 |

It is also noted that a typical prior art tray feeder system is schematically illustrated in FIG. 6 which shows inter alia the intermittent, multi-directional flow of the carton blank, which tends to slow the over-all feeding and folding process down.

SUMMARY DISCUSSION OF THE INVENTION

In order to overcome the problems inherent with the prior art sheet feeding and folding apparatus hereinbefore described with their lack of fast single sheet feeding taking into account the vacuum between sheets and the ink adhesion, as well as folding the sheets into cartons without slowing down the feeding operation, there has been provided by the subject invention a new and novel sheet feeding apparatus and method which allows a plurality of corrugated sheets to be stacked in a gravity feed hopper having new and novel means for breaking the vacuum and adhesion between the respective sheets. The vacuum breaking means comprises overhanging the upper portion of the foremost tray sheet in the hopper in relation to the central or lower portion of the same sheet so that the overhung stacking effect causes the foremost tray sheets to separate at the upper portion thereof, thereby breaking the vacuum and allowing the sheet feeding apparatus to withdraw the upper, overhung portion of the sheet from the hopper and direct it to feed rollers, including in the preferred embodiment rotating split wheels.

There is further provided by the subject invention a new and novel tray carton folding apparatus and method, working in cooperation with the sheet feeding system hereof, which allows a plurality of tray sheets to be fed from the feed rollers through a conveyor, including in the preferred embodiment three cooperating conveyor systems, each having special lugs, working in conjunction with a second set of split wheels, for folding of its end flaps into a tray carton. The folding is continuously and rapidly performed as the sheets progress through the apparatus without hold-up for mechanical movement of manipulating mechanisms for the flaps. The apparatus of the present invention does not require intermittently changing directions from horizontal to vertical and back to horizontal, as occurs in the prior art, but instead, during conveyance and folding, the sheet is always moving in a generally horizontal plane. It is noted that the ends of the carton are initially left open and turned down to slidingly receive bottles or cans or the like in the final packaging state and are then closed by static turning rails.

In summary, the operation of the preferred embodiment is as follows:

The box tray blanks are stacked in a hopper at an angle and are sucked off with a vacuum cup at the forward edge only. The vacuum cup pulls the lead edge down in between a pair of feed rollers, one having a continuous surface of 360° and the other having a split surface in order to allow the box blank to enter the split opening.

When the box blank is pulled into the opening, the top split wheel closes against the bottom roll to form a nip to carry the box blank off the rear hopper supports.

From this point on, the box blank is always moving forward in a horizontal plane by use of a set of lugs attached to a pair of flight chains. This chain is traveling at a predetermined speed to match with a given dimension of the box blank.

As this endless flight chain travels forward above the box blank and moves the box blank forward, the side wall of the box blank which is actually on the leading edge of the box blank as it moves forward is folded upward from the flat plane by use of a round shaped bar moving up from underneath the flat plane.

This side panel is held up only long enough for the flight chain to move the box blank forward until the side panel is vertical to the bottom panel.

As the side panel is being folded up, there are half segment wheels rotating down in order to hold the box tray down in the flat plane. As the flight chain moves the box blank forward, it slowly catches up with the main machine pocket lugs. As these lugs move around the radius of the tail sprocket, they have the correct action of folding up the rear side wall of the box blank.

As the rear side walls starts to fold upward, the flight lug starts around a sprocket and moves away from the box blank.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIGS. 1A & 1B are partial, side, cross-sectional views, showing the sheet feeding and folding sections, respectively, of the preferred embodiment of the present invention; while

FIGS. 3A, 3B & 3C are partial, side, cross-sectional views of the sheet feeding section of the preferred embodiment, similar in perspective to FIG. 1A, showing the sequence of operation as the corrugated box blank is pulled from the feed hopper and fed to the folding section; while FIGS. 4A, 4B, 4C, & 4D are partial, side, cross-sectional views of the folding section of the preferred embodiment similar in perspective to FIG. 1B, showing the sequence of operation as the corrugated blank is conveyed from the feed section and folded into an open-ended tray carton for loading and packaging.

FIG. 7 is a plan view of a typical, unfolded tray blank, corrugated or otherwise, which can be used in the preferred embodiment of the present invention.

DESCRIPTION OF THE PREFERRED EMBODIMENT

1. Introduction

The preferred embodiment of the present invention is directed to a tray feeder for a tray of the type having a front flap, a rear flap and a pair of side flaps, all of said flaps being hingedly connected by means of score lines to a bottom panel, said tray feeder having a feeding section for withdrawing a plurality of unfolded tray blanks, one at a time, from a hopper without destroying the integrity of the withdrawn tray blank and to convey the withdrawn tray blank continuously to a downstream filler unit with the front and real flaps being turned upwardly in the folding section of the machine to a vertical position while the side flaps are turned downwardly to a vertical position prior to filling of the tray with a predetermined quantity of articles, such as for example cans or bottles. Although the preferred embodiments of the feeding and folding sections of the machine could have independently utility with other types of folding and feeding sections, respectively, the two particular feeding and folding sections forming the preferred embodiment of the present invention do interrelate and cooperate with each other to, in combination, form a tray feeder far superior, it is believed, to any other such machine heretofore known.

2. STRUCTURE AND OPERATION OF THE FEEDER SECTION

Figure 1A:
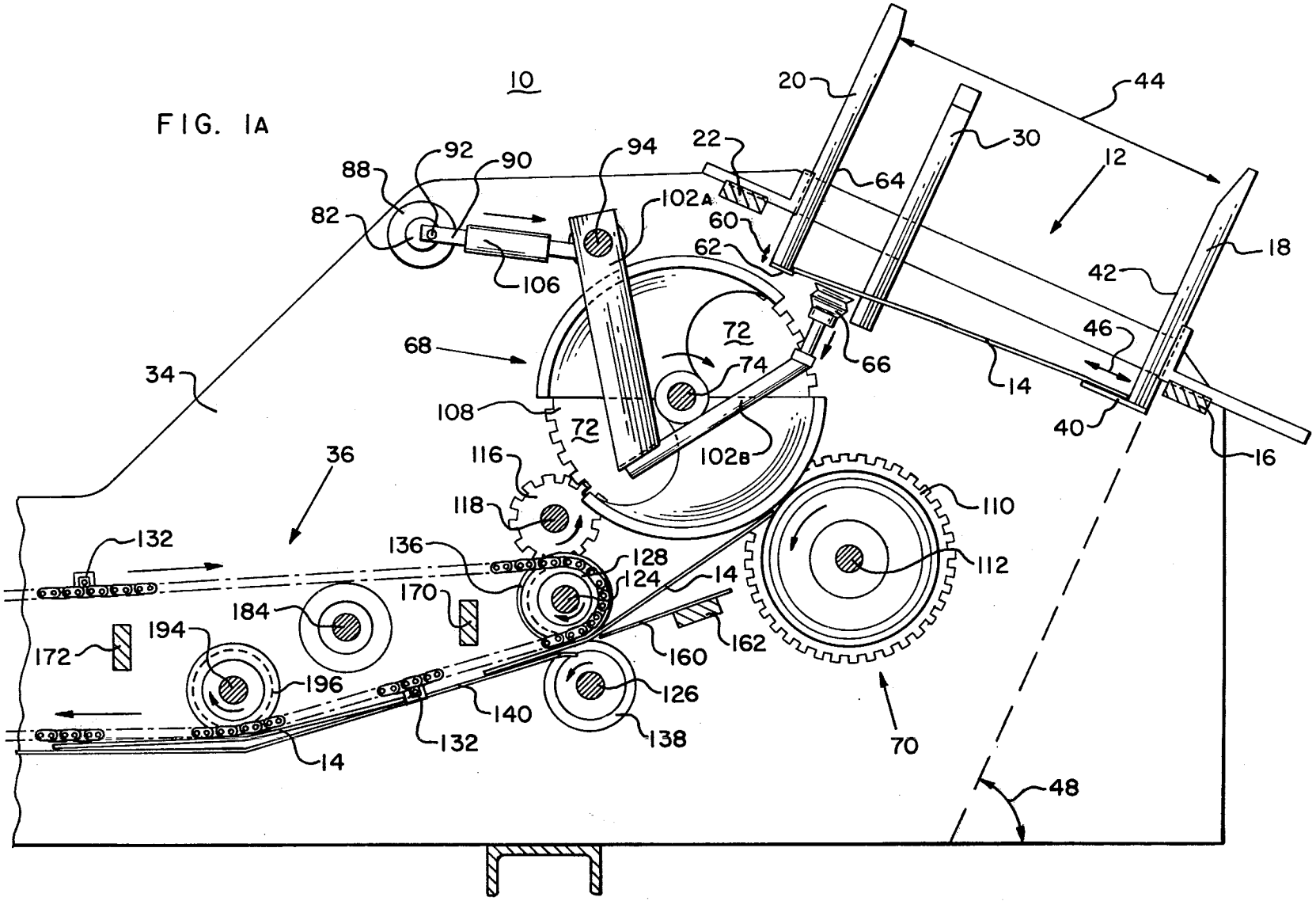
Figure 2A:
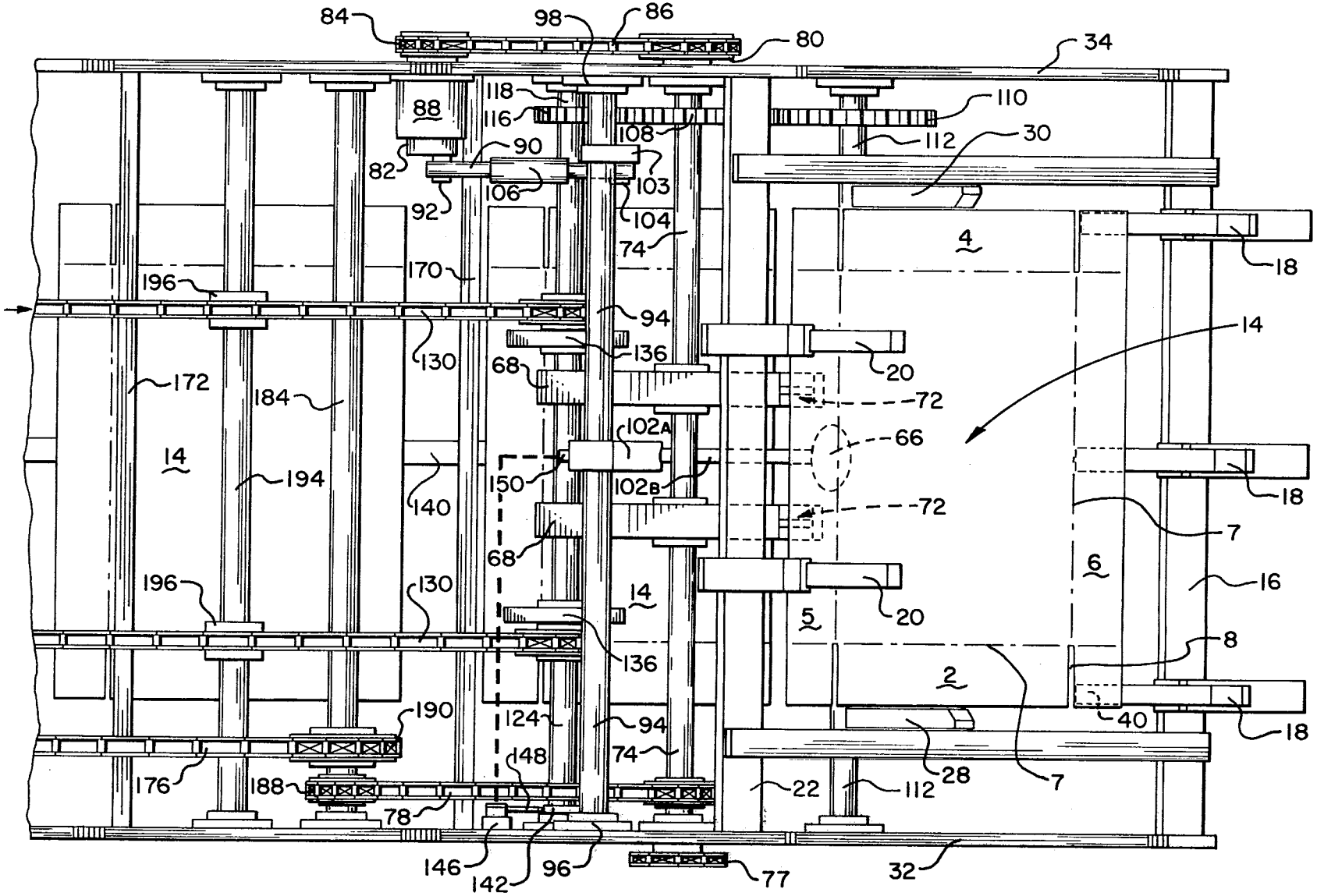
FIGS. 2A & 2B are plan views of the sheet feeding and folding sections, respectively, of the preferred embodiment of the present invention.

Referring now to the drawings in general and in particular to FIGS. 1A & 2A, the sheet feeding section 10 of the preferred embodiment of the present invention comprises a gravity feed hopper 12 into which a plurality of preformed tray blanks 14 are placed prior to their being delivered to the packaging machine.

Figures 1B, 4B, 7:
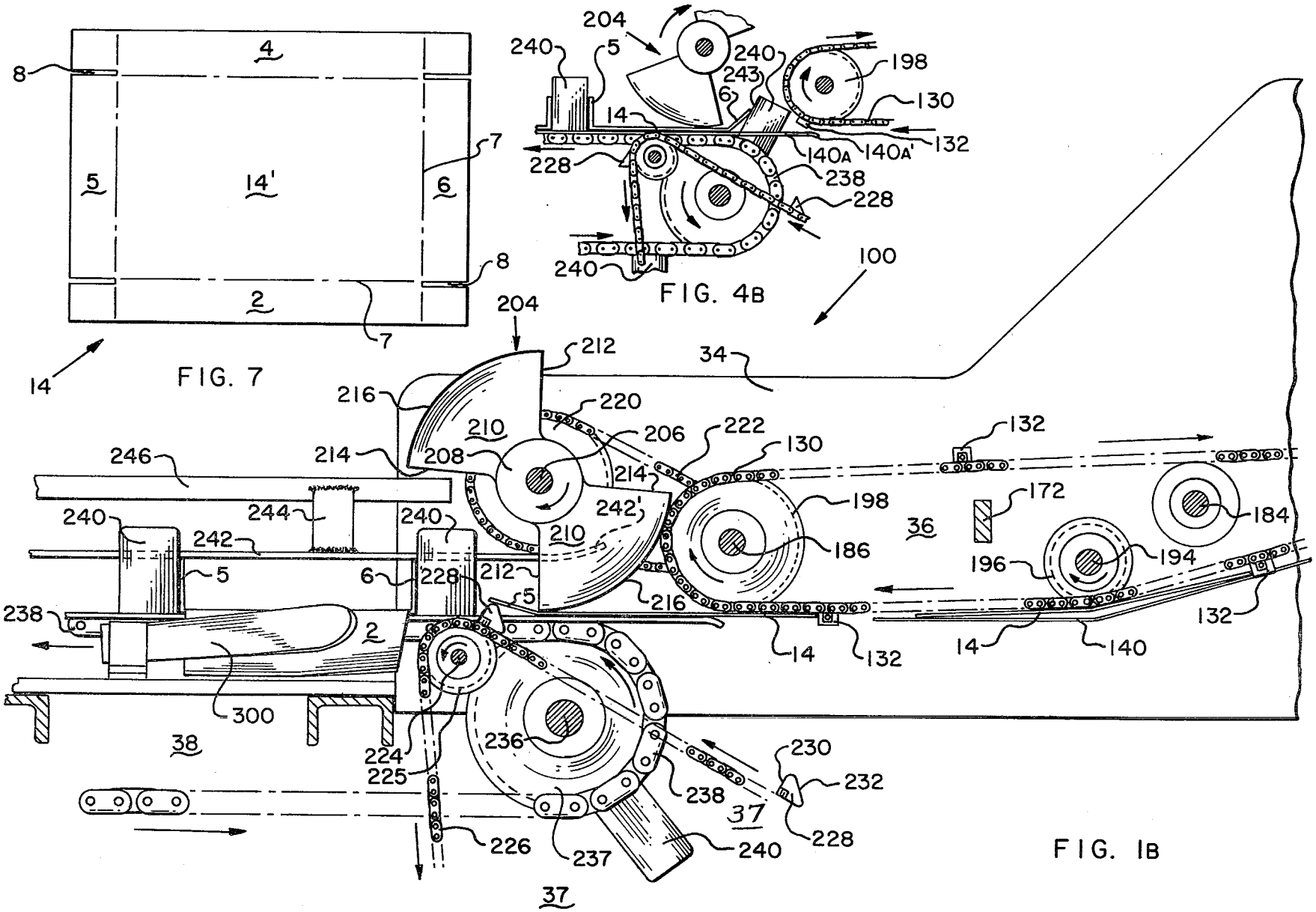

It is noted that, as best seen in FIGS. 2A & 7, each carton consists of a rectangular blank 14 scored at line 7 and precut at slots 8 to form end flaps 2 and 4, and front and rear side flaps, 5 and 6, respectively, extending from the blank's bottom panel 14'.

The individual hopper 12 is fixedly mounted to a frame 16, by means well known in the art, and comprises a set of lower, inclined guide members 18 and a set of upper, inclined guide members 20. The guide members 18 and 20 may be formed in a onepiece construction or may be formed in a two or more piece construction, as shown in the preferred embodiment. The lower guide member 18 is rigidly attached to the frame 16, and the upper guide member 20 is rigidly attached to a frame 22. The support frames 16 and 22 may be adjustably mounted on the basic machine frame in order to accommodate varying sizes of corrugated carton blanks 14. Also carried by the frame are a pair of side guide members 28 and 30 which may be fixed to the frame or may be adjustably mounted thereto by means well known in the art. The frames 16 & 22, carrying the hopper 12, are mounted to the sides 32 and 34 of the tray feeder machine.

In the preferred embodiment shown, the hopper 12 is inclined at an angle of approximately 25° to 30° from the horizontal as shown by the acute angle symbol 48 representing this angle. While it has been found that an angle of approximately 25° to 30° has been suitable and most preferred for most of the applications tested, it is within the spirit and scope of the broader concepts of the invention that the angle 48 could be varied an amount above or below this range in order to accommodate various sizes, thicknesses and other types of carton blanks.

Formed on the lower portion of each of the lower, inclined guide members 18 is an upwardly protruding lower stop 40, which serves as a means for holding the lower portion of the carton blanks 14 in place on the guide members 18 between the side guide members 28 and 30. In the preferred embodiment shown, it has been found that the lower guide stop 40 should protrude beyond the upper surface 42 of the guide member 18 a distance of approximately two and one-half to three and one-half inches for best performance of the sheet feeding apparatus 10. In particular, it is an important aspect of the present invention that the amount of protrusion of the rear stop or support 40 correspond to the width of the prescored rear flaps 6 of the blanks 14. For example, when the length of the carton blank 14 as shown by the arrow distance 44 is eight inches, the length of the lower stop 40, as shown by the arrow distance 46, is preferably two and one-half inches. When the carton blank 14 is approximately 10 inches in length, the length of the lower stop 40 is preferably 3½ inches for optimum performance of the sheet feeding apparatus.

Formed on each of the upper guide members 20, at the distance indicated by the arrow distance 60 in relation to the lower stop 40, is a downwardly protruding, upper stop 62 which serves as the means for retaining the upper tip portion of the carton blanks 14 within the hopper 12. When the blanks 14 are stacked in this manner, the lower portion of the foremost blank will rest on the lower stop 40, while the upper portion of the foremost blank will rest on the upper stop 62 overhanging the lower stop 40 an amount represented by the arrow distance 60. In a like manner each succeeding sheet will tend to overhang the lower stop 40 by an amount which has been found sufficient to break the vacuum between succeeding sheets so that the sheets may be withdrawn from the hopper without the use of complicated fanning mechanisms as described in the before mentioned Scully patent or other complex procedures. In the preferred embodiment shown, the upper stop 62 may be positioned below (arrow distance 60) the stop 40 approximately five-sixteenths of an inch and project approximately three-sixteenths of an inch beyond the interior surface 64 of the upper guide member 20, but it is within the spirit and scope of the invention that this projection may change somewhat depending upon the type, size and weight of the carton blanks 14 to be stacked in the hopper 12.

Referring now in particular to FIG. 1A of the drawings, there is provided in the sheet feeding apparatus portion 10 of the machine a centrally located vacuum cup 66 which is pivotally mounted between a pair of upper, split wheels, feed rollers 68 and lower solid wheel, feed rollers 70 which serve as a means for withdrawing the overhung upper portions of the foremost sheets from the hopper and feeding the sheets to the folding apparatus 100 (to be described fully hereinafter with reference to FIGS. 1B and 2B) of the present invention. Each upper feed roller 68 is a split-type or segmental roller having a series of voids 72 formed in the surface of the roller which corresponds with the timing sequence of the pivoting of the vacuum cup 66. Each lower feed roller 70 is a solid roller, and both the upper and lower rollers 68 and 70 have rubber coated working surfaces forming a frictional covering which aids in forcing into the nips of the rollers 68, 70 the leading edge (flaps) of the carton 14 as the split rollers 68 move through an arc to press against the solid rollers 70.

Figure 3A:
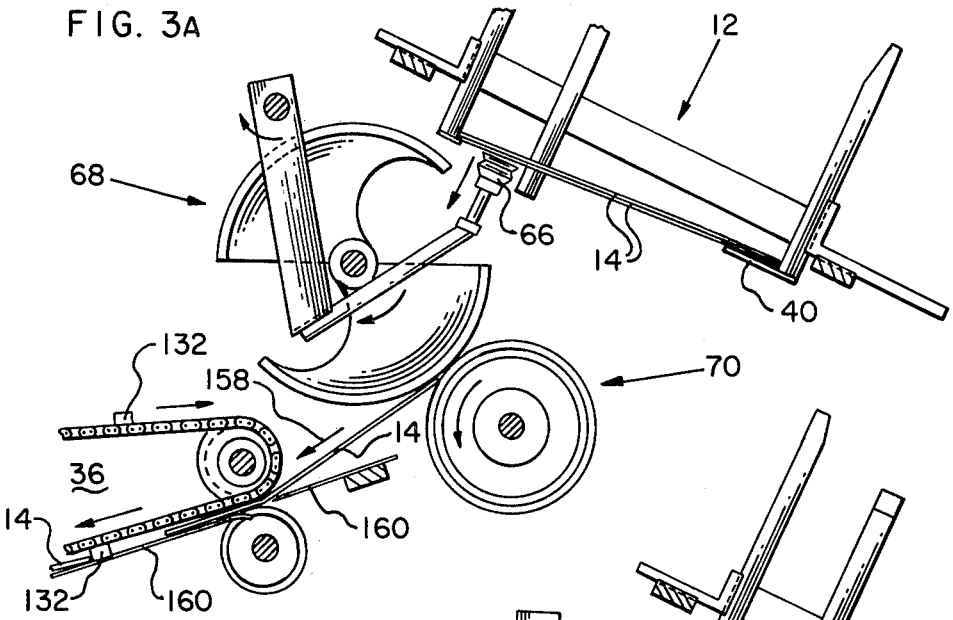
Figure 3B:
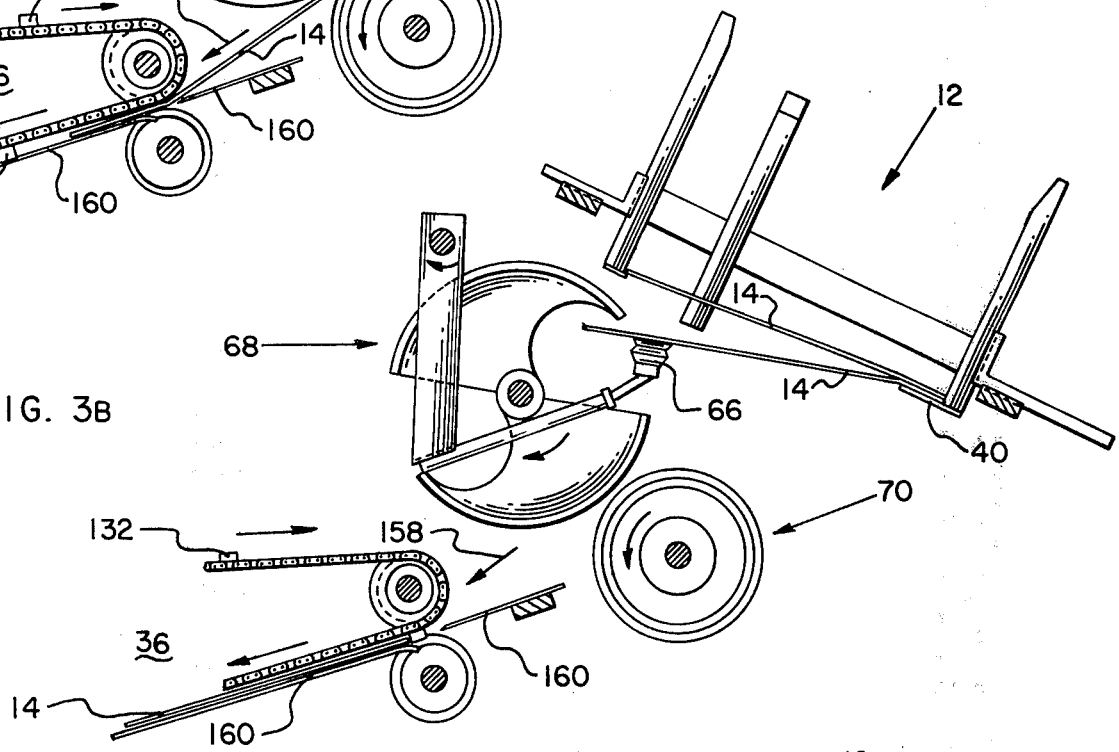
Figure 3C:
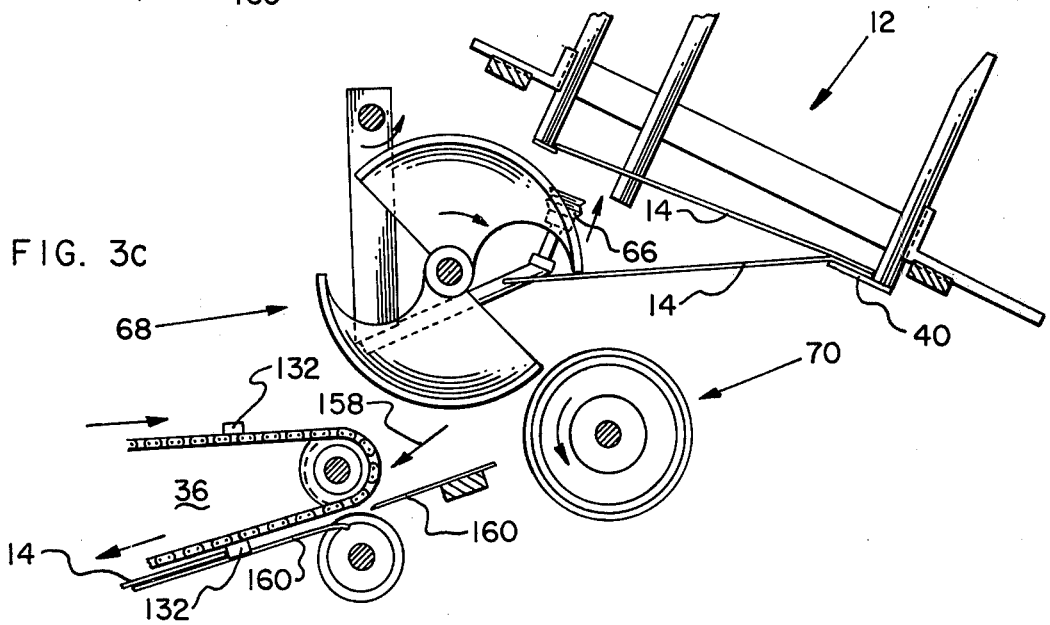
Figure 4A:
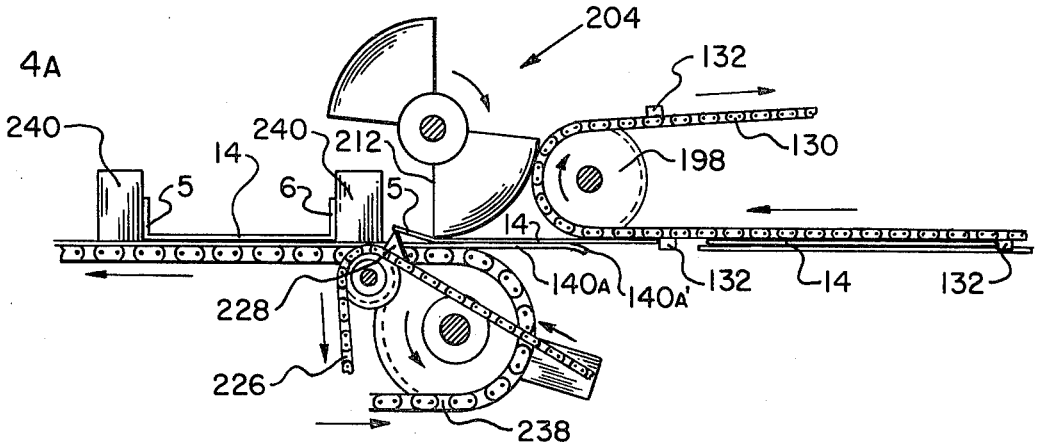
Figure 4C:
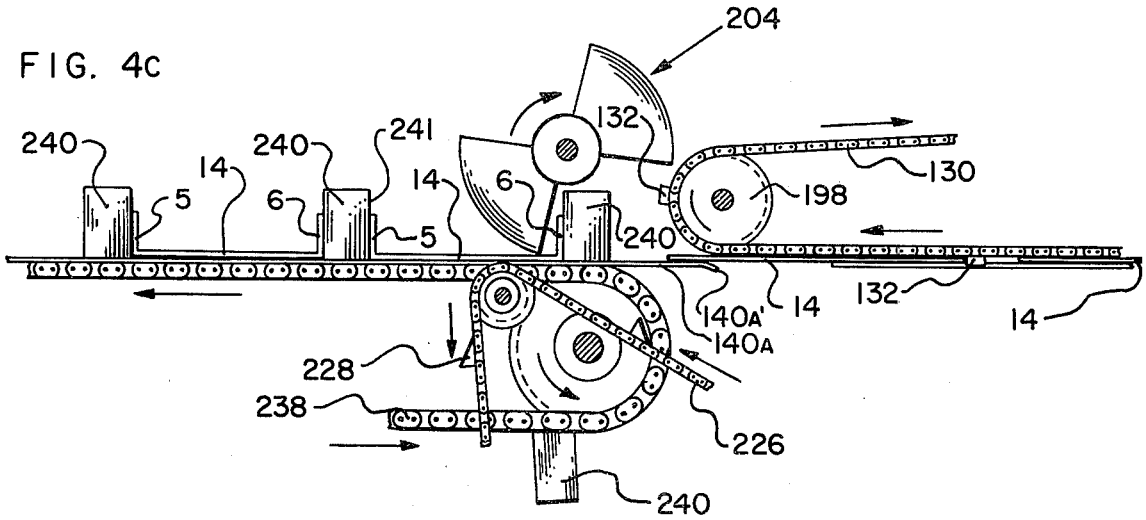
Figure 4D:
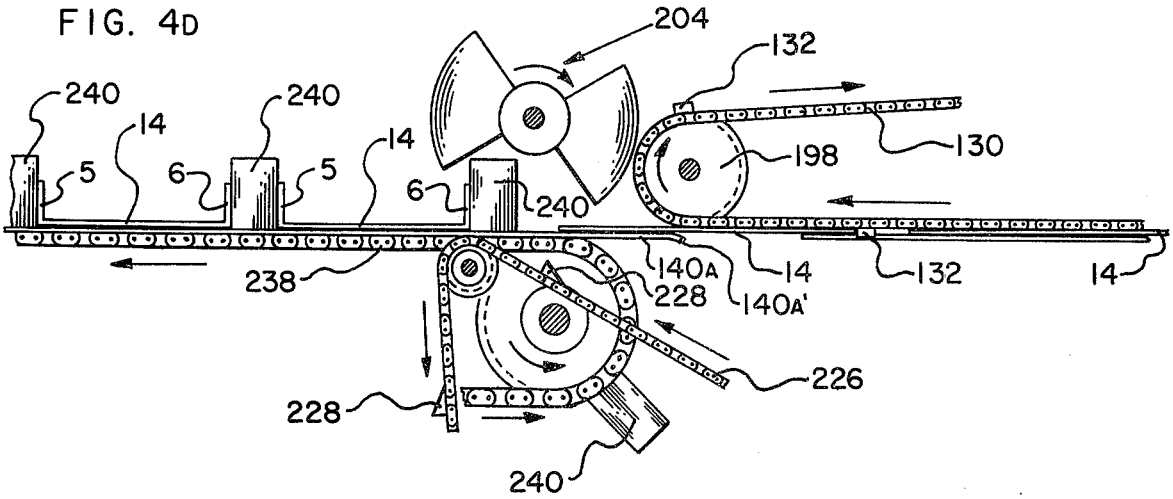

With the use of the overhung hopper 12, which results in the upper portion of the carton blank 14 being spread apart a distance sufficient to break the vacuum between the sheets, the leading edge of the foremost carton blank is pulled out of the hopper 12 by means of the vacuum cup 66 and directed into the feed rollers 68 and 70 which then pull the rest of the carton blank out of the hopper at a very high speed, in a sequential, cyclical operation explained more fully hereinafter with respect to FIGS. 3A–C. With the design of the subject invention, the sheet feeding apparatus 10 is able to run in excess of three hundred cartons per minute of the carton blank design shown in comparison to the old speeds of 200 to 225 cartons per minute.

There will now be described the manner in which the feed rollers 68 and 70 are driven in a timed sequence to the pivoting of the vacuum cup 66 for delivery of the foremost sheet to the folding apparatus 100. The split upper roller 68 is attached to the drive shaft 74 which is rotatably mounted between the sides 32 and 34 by means well known in the art. The shaft 74 is connected in turn to the main drive motor, not shown in the drawings, of the tray feeder machine by driven sprockets 77. The shaft 74 also contains a sprocket 80 which is mounted on the outside of the apparatus in proximity to the side 34. Also carried by the side 34 is a shaft 82 which has formed on the end thereof a sprocket 84. Connected between the sprocket 80 and the sprocket 84 is a secondary drive chain 86 which transmits power from the main drive shaft 74 to the drive shaft 82.

The shaft 82 is rotatably mounted to the side 34 by means of bearing 88 and extends through the bearing 88 and has connected thereto on the end thereof a cam member 90 by means of a pin 92 mounted eccentrically to the shaft 82 by means well known in the art. The suction cup 66 is pivotally mounted on a shaft 94 which is rotatably mounted to the sides 32 and 34 by means of a pair of bearings 96 and 98, as is well known in the art. The suction cup 66 is pivotally mounted on the shaft 94 by means of the V-shaped arm 102A, 102B formed by rectangular bar segment member 102A with integral tube segment 102B, the arm being fixedly attached to the shaft 94 with tube segment 102B under shaft 74. The rectangular bar is also formed on the outer portion of shaft 94 at a predetermined distance and location from arm 103 on shaft 94, arm 103 also attached to a pin 104 which carries one side of the rocker arm 106, which is in turn carried at its other side by the pin 92 formed on the shaft 82.

With the connections just described, it is apparent that, by varying the location and distance of the pin 92 from the center of the shaft 82 and the pin 104 from the center of the shaft 94, the vacuum cup 66 may be made to rock back and forth a pre-determined angle sufficient to pull the foremost sheet of the carton blanks 14 into the feed rollers 68 and 70. By using the reciprocating motion of the cam member 90 acting ultimately on the vacuum cup 66 through the interconnecting structure just described, the vacuum cup 66 is driven in an equal sequence with half of the stroke being in towards the foremost sheet and the remaining half of the stroke being away from the sheet, with the cartons being removed from the hopper 12 at exactly the same speed that the folding apparatus 100 is being run, the timing of the folding apparatus 100 to be described hereinafter.

Referring again particularly to FIGS. 1A and 2A of the drawings, there will be described the manner in which the vacuum cup 66 may be timed to draw a vacuum at the foremost sheet 14 and release the vacuum as the sheet 14 is about to enter into the feed rollers 68 and 70. The main drive shaft 74 in proximity to the side 34 of the packaging apparatus has fixedly attached thereto a gear 108 which drives a mating gear 110 fixedly attached to the shaft 112 which is rotatably mounted, by means well known in the art, to the sides 32 and 34 to drive the lower feed rollers 70. The gear 108 also drives a gear 116 which is fixedly mounted on the shaft 118 which is rotatably mounted by means well known in the art to the sides 32 and 34. The gear 116 drives a plurality of gears 120 and 122 (See FIG. 5) which are rotatably carried by a plurality of shafts 124 and 126 respectively which are also rotatably mounted to the sides 32 and 34 by means well known in the art. The shaft 124 also carries sprockets 128 which drives chains 130 having attached thereto a series of push lugs 132 which cooperate to push the carton blank 14 to the folding apparatus 100. The shaft 124 also carries a feed roll 136, with the shaft 126 carrying a similar feed roll 138 which act in unison to receive the carton blank fed by the feed rollers 68 and 70 and to drive them to a horizontal position to a pair of flat guide rails 140.

Rotatably mounted on the shaft 124 is a cam wheel 142 having a suitable cam surface designed to control the off and on action of the vacuum controller 146 which is driven by the cam follower 148. The vacuum controller, operating off the cam surface, functions to control the vacuum at the vacuum cup 66 through a vacuum line 150 controlling the amount and timing of the vacuum pump (not shown in the drawings). As the cam 142 rotates with the rotation of shaft 124, the vacuum controller 146 will allow a vacuum to be induced at the suction cup 66 whenever the suction cup is in the position shown in FIG. 1A of the drawings. Thereafter, when the shaft 94 is rotated, the suction cup 66 will pull the foremost sheet from the hopper 12 in juxtaposition to feed rollers 68, 70 and the feed rollers 68, 70 will grab the sheet and deliver it to a first conveyor system or unit including feed rollers 136, 138. Shortly prior to this occurring, the vacuum controller 146 will have released the vacuum induced at the suction cup 66 to release the sheet prior to its entrance into the feed rollers 68, 70.

Referring now to FIGS. 3A, 3B and 3C of the drawings, there is illustrated the operational sequence of the feeding section 10 of the machine, showing in particular the production blank 14 being pulled into the feed rollers 68 and 70 in series of steps using the section cup 66. After the suction cup 66 has released the vacuum and is returning to the hopper 12 in order to remove the next foremost sheet in the stack of carton blanks 14, the feed rollers 68 and 70 will now pull the foremost sheet over the edge of the upwardly protruding lower stop 40, bending the rear flap 6 of the blank 14 around the edge of the rear stop or support 40 about the rear scoreline 7 of the blank and out of the hopper stack to feed it downwardly and forwardly to the first conveying unit 36 in the direction shown by the arrow by passing it over the guiding dead plates 114 which are rigidly attached to the frame of the tray feeder machine. It is noted that, as best seen in FIG. 3C, the blank 14 as and after it is released from the vacuum cup 66 comes under the downwardly driving action of the leading edges of the solid segments of the rollers 68 which positively drive the leading edge into the nips of the feed rollers 68, 70.

It can now be readily seen that by inclining the hopper 12 above the conveying unit 36 and by the use of the new and novel means for pulling the foremost sheet from the hopper, the carton blanks 14 are able to be quickly fed at a speed high enough to accommodate a high speed for the folding of the cartons and loading of cans and bottles therein as will next be described. As a result the new and novel sheet feeding apparatus 10 allows the heretofore mentioned unobtainable higher speeds to be reached without the use of intricate and costly mechanical equipment.

In practicing the method of the feed apparatus portion of the invention, the hopper is inclined at an angle sufficient to allow the sheets to be gravity fed out of the hopper with adjustments being made in the hopper for the different sizes and weights of sheets. For this purpose the lower inclined guide members 18 and the guide members 28 and 30 may be faced with "Teflon" or some other similar material which will allow the carton blanks to slide more easily in the hopper without hanging up between the guide members. Before stacking the carton blanks in the hopper, the top and bottom of the hopper are provided with the required upper and lower stops sufficient for operation of that carton blank size which is being run on the packaging machine.

Thereafter the carton blanks are stacked in the hopper so that the foremost sheet rests on the upper and lower stops with the upper portion of the foremost sheet being overhung in relation to the lower portion of the same sheet. As a result of this overhang the vacuum between the successive sheets is broken sufficiently to allow the foremost sheet to be withdrawn from the hopper by the rotatably mounted suction cup 66 which directs the upper portion of the sheet into the feed rollers 68, 70. By successively using the rotatably mounted suction cup 66 to withdraw the foremost sheet from the stack, the feed mechanism is able to supply the carton blanks to the packaging machine at a high speed.

3. STRUCTURE AND OPERATION OF FOLDING SECTION

Figure 2B:
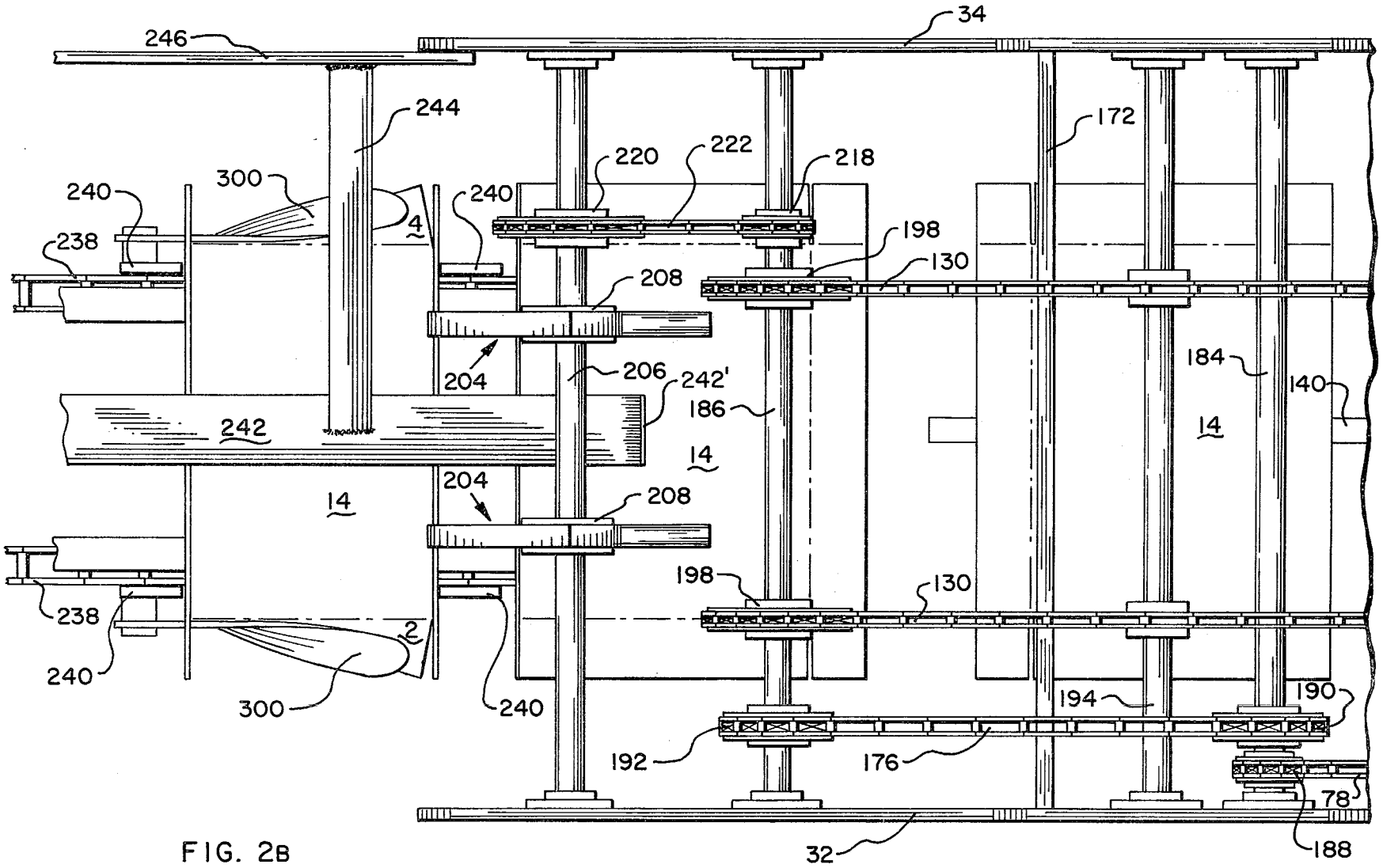

The structure of the folding section 100 of the machine which forms a contiguous part of the feeding section 10 is best illustrated in FIGS. 1B and 2B, which figures are contiguous with FIGS. 1A and 2A, respectively.

The folding section 100 includes three conveyor units 36, 37, and 38, which in cooperation with a pair of hold down, segmental wheels 204, fold up the side flaps 5, 6 of the carton blank 14 in preparation for the loading of the carton with the appropriate articles. Prior to loading, a pair of static, side, folding rails 300 fold the end flaps 2, 4 down. After the loading of the articles, another set of static, side, folding rails (not illustrated) fold up the end flaps 2, 4 as the side-folded, loaded cartons are conveyed past, and the packaging is then completed.

All as will be explained more fully below, the first conveyor unit 36 with its pushing lugs 132 push the carton blanks 14 from the feeding section 10 to and into the folding section 100 which is located at the junction of all three conveyor units 36 – 38 and the location of the split wheels 204. The first conveyor unit 36, which is also associated with the hopper feeder unit as described above, takes the downwardly and forwardly moving tray blank 14 and continuously moves it in a generally forward direction. In doing so, the first conveyor unit 36 serves as a transfer means for transferring the direction of the downwardly moving blank to a forward and horizontal moving direction, with the blank moving in a continuous motion and direction without intermittently stopping and starting. It is further noted that the first conveyor unit 36 initiates in proximity to the feed rollers 68, 70, which serve as an initial conveyor means, and terminates in proximity to the hold down wheels 204.

The second conveyor unit 37 is an upwardly running, inclined kicker unit having rounded shaped lugs 238 and is positioned below the first, horizontally disposed conveyor unit 36. The most preferred angle of inclination has been found to be approximately an angle of 30°, as measured from the horizontal. This second conveyor unit 37 kicks up and bends the front flap 5 of the blank upwardly about its scoreline 7 to an upwardly inclined position, while the first conveyor unit 36 is continuously moving the tray blank 14 in a generally horizontal direction. The hold down wheels 204, which are positioned above the second conveyor unit 37, hold down the tray blank 14 at the front scoreline 7 as the tray blank is driven continuously forward in a general horizontal direction by the first conveyor unit 36 and also serves to later hold down the tray blank 14 at the rear scoreline 7 when the rear flap 6 is bent upwardly. The third conveyor unit 38, which is horizontally disposed, works in cooperative association with the second conveyor unit 37 and retains the front flap 5 in a vertical position while bending the rear flap 6 about its scoreline 7 against the hold-down wheels 204 to a vertical position by means of special elongated lugs 240. The third conveyor unit further serves to retain the rear flap 6 in a vertical position while transporting the then end folded tray carton in a horizontal forward direction. Static, side, folding rails positioned beside the third conveyor unit 38 and downstream from the hold down wheels 204 are provided to initially turn the end flaps 2, 4 about their scorelines 8 to a downwardly vertical position while the front and rear flaps 5, 6 are being held in an upwardly vertical position by the third conveyor unit 38, and then to subsequently turn the end flaps, 2, 4 to an upwardly vertical position after the tray cartons are loaded.

The aforedescribed operations and relationships will become more clear after reading of the detailed description of the folding section 100 presented below.

Referring to FIGS. 1A, 1B, 2A 2B and 5, the center of the machine is supported by lateral frame members 170 and 174, extending from side 32 to side 34 and attached thereto by means well known in the art. Also mounted between sides 32 and 34 is transmission shafts 184 and 186, rotatably mounted thereon by means well known in the art. Also, positioned on shaft 74 is sprocket 76, and positioned on shaft 184 is sprocket 188 with endless belt 78 looped therebetween. Also, positioned on shaft 184 is sprocket 190, and positioned on shaft 186 is sprocket 192 with endless belt 176 looped therebetween. Power is transmitted from the drive shaft 74 to the folding section 100 by shaft 186 and auxiliary drive system 310. To keep push lugs 132 properly aligned, a shaft 194 is rotatably mounted between sides 32 and 34 by means well known in the art. Sprockets 196 are formed on shaft 194 for positioning and supporting of the lower portion of chain loop 130 in proximity to middle dead plate 140.

The first conveyor unit 36 of the system is timed with feed wheels 68, 70 to position push lugs 132 behind sheets 14 as they leave the feed rolls 136 and 138 to urge them to complete the transition of sheet 14 from the initial, inclined feed angle to approximately a horizontal position for introduction into the folding section 100.

Referring now to FIGS. 1B and 2B and 4A, 4B, 4C & 4D, there is shown sprockets 198 positioned on shaft 186 to complete the endless loop formed by chains 130. To permit the operation of endless chain 130 and push lugs 132, downwardly curved edge or lip 140A' is formed at the end of the dead plate 140A facing the first conveyor unit 36. This edge assists the entrance of the blank sheets 14 and permits the upturn of push lugs 132 while still permitting the reception of sheets 14 into the folding apparatus 100.

The folding of sheets 14 into cartons is accomplished by the use of a pair of hold down, segmented or split wheels 204 mounted on shaft 206 working in conjunction with the three conveyor units 36, 37 and 38 with their special lugs. Shaft 206 is rotatably mounted between sides 32 and 34 by means well known in the art. Split wheels 204 include circular hubs 208 having circular sections 210 radiating therefrom. Each circular section 210 is formed by arcuate surface 216 bounded by leading edge 212 and trailing edge 214. The working surface 216 of the hold down wheels 204 have a frictional covering of rubber thereon, and, in a fashion similar to feed rolls 68, work in conjunction with a pair of lower solid wheels (analogous to feed rolls 70).

Also positioned on shaft 186 is sprocket 218, and positioned on shaft 206 is sprocket 220. Sprockets 218 and 220 cooperate with chain 222 provided therebetween to form an endless chain for driving split wheels 204 in timed synchronization with drive shaft 74.

Shaft 224 is also rotatably mounted on walls 32 and 34 by means well known in the art. Sprocket 225 is positioned on shaft 224 to receive moving chain 226. Mounted on chain 226 by welding or other suitable means are rounded shaped lugs 228 having leading straight edge 230 and sloped following edge 232 of sufficient height to support the leading edge of each sheet 14 and serving as moving risers. Moving risers or lugs 228 are spaced apart a sufficient distance to permit the use of only one with each sheet 14.

Shaft 236 is mounted rotatably by means not shown but well known in the art below walls 32 and 34. Sprockets 237 are formed on shaft 236 to receive moving chains 238, and are driven by the auxiliary drive system 310 (note FIG. 5) in synchronization with the driveshaft 74. Formed on chain 238 are main machine pocket lugs 240 spaced apart a sufficient distance to hold and position a carton with its sides 5, 6 folded vertically.

Mounted at the end of the folding section 100 is support bracket 246 attached to the wall 34. A lateral support bar 244 is attached to bracket 246 which in turn supports in a horizontally disposed manner a static hold down bar 242 having an upturned leading edge 242'. The hold down bar 242 is parallel to the chains 238 and is located directly above the folded cartons to hold them down.

Figure 6:
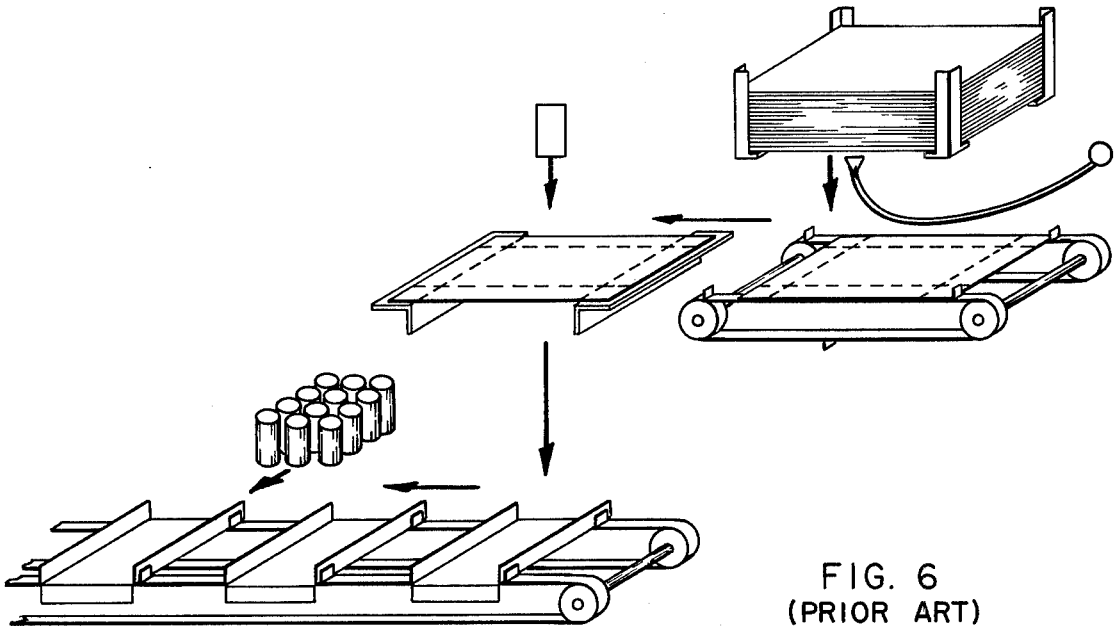
FIG. 6 (PRIOR ART)
FIG. 6 is a side, perspective, schematic view of the basic working elements of a typical prior art feeding and folding machine for tray cartons with the elements positioned in a "flow chart" type array.

Referring now to FIGS. 4A, 4B, 4C & 4D of the drawings, there is illustrated the operational sequence of the folding section 100, showing the production blank 14 being folded by split wheels 204 in conjunction with the three conveyor units 36 – 38. As production blank 14 slides onto the deat plate 140*a*, the beveled edge 232 of riser 228 moving in the direction shown by the arrows urges the leading edge of the blank 14 against the leading edge 212 of split wheels 204 rotating in the direction shown by the arrow (Note FIG. 4A). Split wheels 204 and riser 228 continue to move forward catching up with the trailing edge 241 of the lug 240 moving in the direction of arrow 248 and urging the leading flap 5 of the blank 14 against the edge 241. The riser 228 disengages from flap 5, and split wheels 204 continues to urge the blank 14 forward. The trailing flap 6 of sheet 14 is forced upward parallel to the other side of carton by the leading edge 243 of the next lug 240 in conjunction with the trailing edge 214 of split sheels 204 (Note FIG. 4B). The cartons are kept in place by the static hold-down bar 242 (Note FIG. 1B) until cans or other articles are placed on the bottom 14' of the end folded cartons in a fashion similar to that shown in the prior art of FIG. 6.

It should be noted that the figures are for general illustration and are not intended to be exact scale drawings, and that for simplicity purposes the side flaps 2 of the blanks 14 (which would be partially or fully folded over) are not fully illustrated in FIGS. 4A – 4D.

Figure 5:
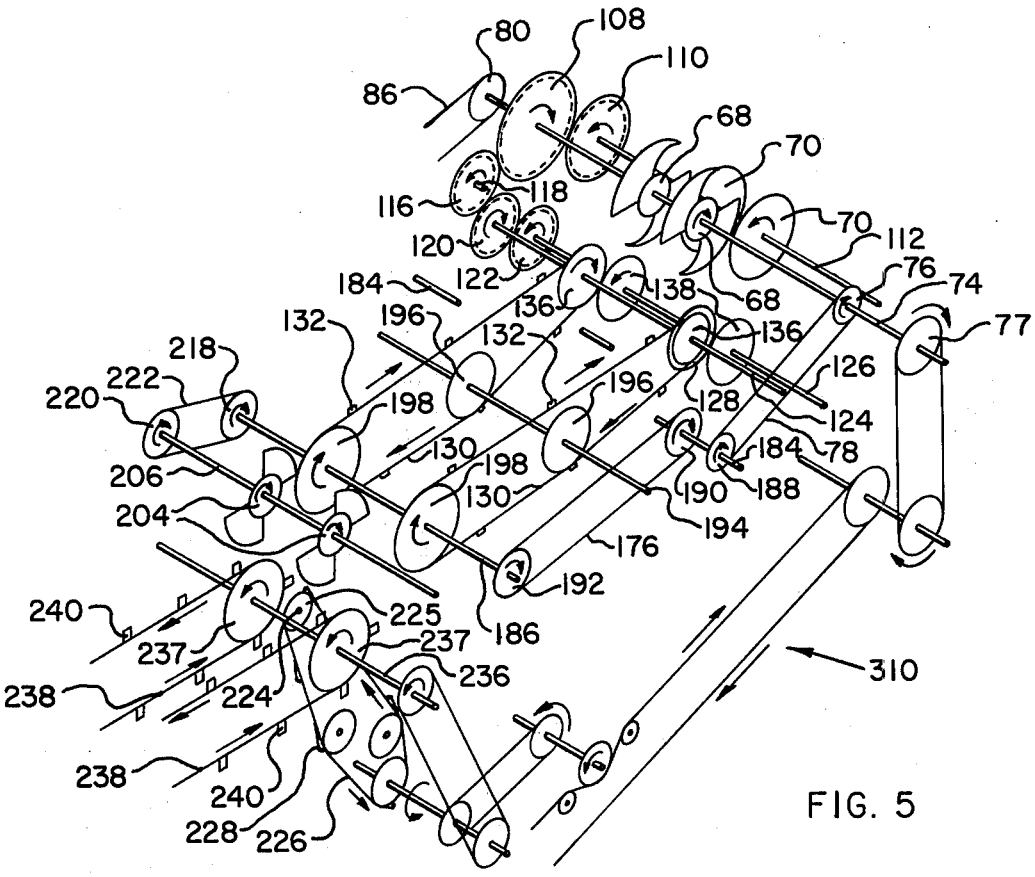
FIG. 5 is a top, perspective, generalized, schematic view of the coordinated, interrelated drive systems utilized for the various sections and moving elements used in the preferred embodiment of the present invention.

The timed relationships between the shafts 74, 112, 124, 126, 186, 206, 224, and 223 and their associated operative elements should now be clear, particularly in conjunction with the schematic view of the overall synchronized drive system shown in FIG. 5. It should now be readily seen that by employing the new and novel means of the folding section of the present invention, the carton blanks 14 are able to be quickly folded at a speed. high enough to keep synchronized with the high speed at which the feeding section 10 operates.

Although the system described in detail supra has been found to be most satisfactory and preferred, many variations in structure and method are, of course, possible. Because many varying and different embodiments may be made within the scope of the inventive concept herein taught and because many modifications may be made in the embodiment herein detailed in accordance with the descriptive requirements of the law, it should be understood that the details herein are to be interpreted as illustrative and not in a limiting sense.

I claim:

1. A tray feed for tray blanks of the type having a front flap, a rear flap and a pair of side flaps, all of the flaps being hingedly connected by scorelines to a bottom panel, said tray feeder being designed to withdraw a plurality of unfolded tray blanks, one at a time, from a hopper without destroying the integrity of the withdrawn tray blank and to convey the withdrawn tray blank continuously to a downstream filler unit with the front and rear flaps of the tray blanks being turned upwardly to a vertical position while the side flaps are turned upwardly to a vertical position while the side flaps are turned downwardly to a vertical position prior to filling of the bottom panel with a predetermined quantity of cans or bottles, comprising:

a. a hopper feeder unit, comprising
   1. an inclined hopper for receiving and holding the plurality of tray blanks;
   2. vacuum means, associated with said hopper, for withdrawing the tray blanks, one at a time, from said hopper by bending the tray blank downwardly from the front flap while pivoting the tray blank about the rear score-line, which hingedly connects the rear flap to the bottom panel;
   3. conveyor means, associated with said feeder unit, for conveying the withdrawn tray blank in a downward direction from said hopper and forward away from said hopper;

b. first, horizontal conveyor unit means, associated with said hopper feeder unit, for receiving the downwardly and forwardly moving tray blank and continuously moving it horizontally forward away from said hopper;

c. second, upwardly running, inclined kicker conveyor unit means, positioned below said first horizontal conveyor unit means, for kicking up and bending upwardly the front flap of the tray blank, about the front scoreline, which hingedly connects the front flap to the bottom panel, to an upwardly inclined position while said first conveyor unit means is continuously moving the tray blank in said forward, horizontal direction;

d. hold-down means, positioned about said second conveyor unit means, for holding down the front flap as the tray blank moves in said forward horizontal direction said hold down means also for holding down the rear flap when the rear flap is bent upwardly;

e. third generally horizontal conveyor unit means, associated with said second conveyor unit means for retaining the front flap in a vertical position while bending the rear flap about the rear scoreline to a vertical position, the rear flap being held down by said hold down means, said third conveyor unit means further serving to retain the rear flap in a vertical position while transporting the tray blank in said horizontal, forward direction; and f. turning means, associated with said third conveyorunit mens, for turning the side flaps about their scorelines to a downwardly vertical position while said front and rear flaps are being held in an upwardly vertical position.

2. The tray feeder as defined in claim 1 wherein said inclined hopper has formed thereon a rear support which is designed to support the rear flap of the tray and is designed to allow the tray to be bent around and edge of the rear support about the rear scoreline.

3. The tray feeder as defined in claim 2 wherein said rear support is approximately 2 1/2 inches in width which corresponds to the width of the rear flap.

4. The tray feeder as defined in claim 1 wherein said inclined hopper is inclined at approximately 25° to 30° to the horizontal.

5. The tray feeder as defined in claim 1 wherein said conveying means comprises at least one upper segmental wheel in combination with at least one solid lower wheel.

6. The tray feeder as defined in claim 1 wherein said conveying means comprises at least two upper segmental wheels in combination with at least two lower solid wheels.

7. The tray feeder as defined in claim 1 wherein said first conveyor unit means initiates in proximity to said conveyor means and terminates in proximity to said hold down means.

8. The tray feeder as defined in claim 1 wherein said second kicker conveyor unit means runs upwardly to said first horizontal conveyor unit means and forwardly away from said rear flap hold at an inclined angle prior to kicking up the front flap of the tray blank.

9. The tray feeder as defined in claim 8 wherein the angle of said kicker conveyor is approximately thirty degrees below the horizontal.

10. The tray feeder as defined in claim 1 wherein said hold-down means comprises at least one rotating segmental wheel.

11. The tray feeder as defined in claim 1 wherein said hold-down means comprises at least two rotating segmental wheels.

12. The tray feeder as defined in claim 10 wherein said segmental wheel has formed thereupon a frictional covering.

13. The tray feeder as defined in claim 11 wherein said segmental wheels have formed thereupon frictional coverings.

14. The tray feeder as defined in claim 12 wherein said frictional covering comprises a rubber covering.

15. The tray feeder as defined in claim 13 wherein said frictional coverings comprise a rubber covering.

16. The tray feeder as defined in claim 10 wherein said segmental wheel and said first conveyor unit means rotate in the same direction.

17. The tray feeder as defined in claim 1 wherein said third conveyor unit means rotates in a direction opposite to said first conveyor unit means but in the same direction as said second conveyor unit means.

18. The tray feeder as defined in claim 17 wherein said third conveyor unit means has formed thereupon a plurality of elongated lugs for turning up the rear flap and for holding the front flap and the rear flap in position after they have been turned up.

19. The tray feeder as defined in claim 1 wherein said turning means comprises a plurality of folding rails positioned beside the third conveyor unit means and below said hold-down means.

20. An improved hopper feeder unit for a tray feeder for a corrugated tray of the type having a front flap, a rear flap and a pair of side flaps, all of the flaps being hingedly connected by scorelines to a bottom panel, said hopper feeder unit being designed to withdraw a plurality of unfolded trays, one at a time, from the hopper without destroying the integrity of the withdrawn tray blank, comprising:

a. an inclined hopper for receiving and containing a plurality of corrugated tray blanks, said hopper being inclined at an angle in the range of 25° to 30° to the horizontal;

b. vacuum means, associated with said hopper for withdrawing the tray blanks, one at a time, from said hopper by bending the tray downwardly from the front flap while pivoting the tray about the rear scoreline which hingedly connects the rear flap to the bottom panel; and c. means, associated with said hopper for conveying the withdrawn tray blank in a downwardly direction from said hopper and forwardly away from said hopper.

21. A tray feeder for a corrugated tray of the type having a front flap, a rear flap and a pair of side flaps, all of the flaps being hingedly connected by scorelines to a bottom panel, said tray feeder being designed to withdraw a plurality of unfolded trays, one at a time, from a hopper without destroying the integrity of the withdrawn tray blank and to convey the withdrawn tray blank continuously to a downstream filler unit with the front and rear flaps of the tray blanks being turned upwardly to a vertical position while the side flaps are turned downwardly to a vertical position prior to filling of the bottom panel with a predetermined quantity of cans or bottles, comprising:

a. a hopper feeder unit, comprising 1. an inclined hopper for receiving and containing the plurality of tray blanks;

2. vacuum means, associated with said hopper, for withdrawing the corrugated tray blanks, one at a time, from said hopper by bending the tray blank downwardly from the front flap while pivoting the tray blank about the rear scoreline, which hingedly connects the rear flap to the bottom panel;

3. conveyor means, associated with said feeder unit, for conveying the withdrawn tray blank in a downward direction from said hopper and forward direction away from said hopper; and forwardly direction being determined as the direction from the section of said hopper wherein the rear flap is located to the portion of said hopper wherein the front flap is located;

b. first conveyor unit means, associated with said hopper feeder unit, for receiving the downwardly and forwardly moving tray blank and continuously moving it horizontally and in said forward direction;

c. second, upwardly running, inclined kicker conveyor unit means, positioned below said first horizontal conveyor unit means, for kicking up and bending upwardly the front flap of the tray blank, about the front scoreline, which hingedly connects the front flap to the bottom panel, to an upwardly inclined position while said first conveyor unit means is continuously moving the tray blank in said forward horizontal direction, said first conveyor unit means rotating in one direction while said second conveyor unit means rotates in an opposite direction;

d. hold-down means, positioned above said second conveyor unit means, for holding down the front flap as the tray blank moves in said forward, horizontal direction said hold down means also for holding down the rear flap when the rear flap is bent upwardly, said hold down means comprising at least one segmental wheel having a rubber strip formed on the outer edge thereof with said segmental wheel turning in the same direction as said first conveyor unit means;

e. third generally horizontal conveyor unit means, associated with said second conveyor unit means, for retaining the front flap in a vertical position while bending the rear flap about the rear scoreline to a vertical position, the rear flap being held down by said fold down means, said third conveyor unit means further serving to retain the rear flap in a vertical position while transporting the tray blank in said horizontal, forward direction, said third conveyor unit means rotating in the same direction as said second conveyor unit means rotates; and f. turning means, associated with said third conveyor unit means, for turning down the side flaps about their scorelines to a downward vertical position, said turning means comprising a plurality of folding rails positioned generally on each side of said third conveyor unit means and being located below said hold down means.

22. A method for continuously and rapidly feeding a plurality of corrugated trays, having a front flap, a rear flap and a pair of side flaps, all of said flaps being hingedly connected by means of scorelines to a bottom panel, to a case packer wherein the corrugated tray has its front and rear flaps folded upwardly while its side flaps are folded downwardly, comprising the steps of:

a. providing a hopper feeder;

b. providing a first conveyor unit downstream from said hopper feeder;

c. providing a second conveyor unit downstream from said first conveyor unit;

d. providing a hold-down means downstream from said first conveyor unit and above said second conveyor unit;

e. providing a third conveyor unit downstream from said hold-down means;

f. providing a turning down means for turning down the side flaps downstream from the hold down means;

g. intermittently withdrawing a corrugated tray blank one at a time from the hopper feeder while bending the tray blank about the scoreline hingedly connecting the rear flap to the bottom panel;

h. continuously moving the withdrawn corrugated tray blank downstream with said first conveyor unit;

kicking up the front flap of the corrugated tray blank with the second conveyor unit while holding down the bottom panel with the hold down means;

j. kicking up the rear flap of the corrugated tray blank with the third conveyor unit while still holding down the bottom panel with the hold down means; and k. turning down the side flaps of the corrugated tray blank with said turn down means while holding up the front and rear flaps with said third conveyor.

23. A continuous tray feeder to a tray blank of the type having a front, rear and a pair of side flaps, all of the flaps being hingedly connected by scorelines to a bottom panel, said tray feeder being designed to withdraw a plurality of unfolded tray blanks, one at a time, from a hopper without destroying the integrity of the withdrawn tray blank and to continuously convey the withdrawn tray blank to a downstream filler unit with the front and rear flaps of the tray blanks being turned upwardly to a vertical position while the side flaps are turned downwardly to a vertical position prior to filling of the bottom panel with a predetermined quantity of cans or bottles, comprising:

a. inclined hopper feeder unit means for receiving and holding the plurality of tray blanks, said hopper feeder unit means further comprising means for withdrawing the tray blanks one at a time from said hopper feeder unit means by bending the tray blank about the rear scoreline, which hingedly connects the rear flap to the bottom panel, said hopper feeder unit means further comprising means for conveying the withdrawn blank downwardly and away from said hopper feeder unit means;

b. transfer means, associated with said hopper feeder unit means and located downstream therefrom, for transferring the direction of thd downwardly moving tray blank to a generally forward and horizontal moving direction, said blank moving in a continuous motion and direction without intermittently stopping and starting;

c. flap turning means, associated with said transfer means, and located downstream therefrom, for turning up the front and rear flaps while turning down the side flaps, the tray blank moving in a continuous motion and direction without intermittently stopping and starting, the flap turning means including moving members which manipulate the position of the flaps.

24. The tray feeder as defined in claim 23 wherein said hopper feeder unit means and said transfer means are combined into one unit.

25. A tray feeder for a corrugated tray blank of the type having a front flap, a rear flap and a pair of side flaps, all of the flaps being hingedly connected by scorelines to a bottom panel, said tray feeder being designed to withdraw a plurality of unfolded tray blanks one at a time, from a hopper without destroying the integrity of the withdrawn tray blank and to convey the withdrawn tray blank continuously to a downstream filler unit with the front and rear flaps of the tray blank being turned upwardly to a vertical position while the side flaps are turned downwardly to a vertical position prior to filling of the bottom panel with a predetermined quantity of cans or bottles, comprising:

a. a hopper feeder unit holding the tray blanks;

b. conveyor means, associated with said hopper feeder unit, for conveying the tray blank downwardly and forwardly away from said hopper feeder unit;

c. first conveyor unit means, associated with said hopper feeder unit, for receiving the downwardly and forwardly moving tray blank and continuously moving it horizontally in said forward direction;

d. second, upwardly running, inclined kicker conveyor unit means, positioned below said first horizontal conveyor unit means, for kicking up and bending upwardly the front flap of the blank about the front scoreline, which hingedly connects the front flap to the bottom panel, to an upwardly inclined position while said first conveyor unit means is continuously moving the tray blank in said forward, horizontal direction, said first conveyor unit means rotating in one direction while said second conveyor unit rotates in an opposite direction;

e. hold-down means, positioned above said second conveyor unit means, for holding down the front flap as the tray blank moves in said forward horizontal direction said hold down means also for holding down the rear flap when the rear flap is bent upwardly, f. third generally horizontal conveyor unit means, associated with said second conveyor unit means, for retaining the front flap in a vertical position while bending the rear flap about the rear scoreline to a vertical position, the rear being held down by said hold-down means, said third conveyor unit means further serving to retain the rear flap in a vertical position while transporting the tray blank in said horizontal forward direction, said third conveyor unit means rotating in the same direction as said second conveyor unit means rotates; and g. turning means, associated with said third conveyor unit means, for turning down the side flaps about their scorelines to a downward vertical position.

26. The tray feeder is defined in claim 25 wherein said hold-down means comprises at least one segmental wheel, with said segmental wheel turning in the same direction as said first conveyor unit means.

* * * * *

UNITED STATES PATENT OFFICE

CERTIFICATE OF CORRECTION

Patent No. 4,034,658 Dated July 12, 1977

Inventor(s) Earle C. Sherman

It is certified that error appears in the above-identified patent and that said Letters Patent are hereby corrected as shown below:

Column 4, line 11, delete "walls" and insert in place thereof -- wall --.
Column 5, line 5, delete "independently" and insert in place thereof -- independent --.
Column 6, line 39, delete "wheels" and insert in place thereof -- wheel --.
Column 7, line 28, insert quotation marks around the V -- "V" --.
Column 9, line 7, before the word "guide" insert the word -- side --.
Column 11, line 56, delete "deat" and insert in place thereof -- dead --.
Column 12, line 2, delete "sheels" and insert in place thereof -- wheels --.
Column 12, line 16, following "Fig. 5" should begin a new paragraph.
Column 12, line 33, delete the word "feed" and insert in place thereof the word -- feeder --.
Column 12, line 42, delete the following: "while the side flaps are turned upwardly to a vertical position"
Column 13, line 9, following the word "direction" insert a -- , --.

Column 13, line 13, following the word "means" insert a -- , --.
Column 13, line 22, delete "veyorunit mens" and insert in place thereof -- veyor unit means --.
Column 13, line 29, delete "and" following the word around, and insert in place thereof -- an --.
Column 11, line 15, delete "surface" and insert in place thereof -- surfaces --.

UNITED STATES PATENT OFFICE

CERTIFICATE OF CORRECTION

Patent No. 4,034,658 Dated July 12, 1977

Inventor(s) Earle C. Sherman

It is certified that error appears in the above-identified patent and that said Letters Patent are hereby corrected as shown below:

Column 14, line 39, following the word "hopper" insert a -- , --.
Column 14, line 69, delete "and" and insert in place thereof -- said --.

Column 15, line 25, following the word "direction" insert a -- , --.
Column 16, line 9, label the new paragraph -- i --.
Column 16, line 19, delete "to" and insert in place thereof -- for --.
Column 16, line 45, delete "thd" and insert in place thereof -- the --.
Column 16, line 66, following the word "blanks" insert a -- , --.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*